United States Patent [19]

DeWoskin

[11] Patent Number: 4,914,843

[45] Date of Patent: Apr. 10, 1990

[54] IDENTIFICATION BAND

[75] Inventor: Irvin S. DeWoskin, Barnhart, Mo.

[73] Assignee: Barnhart Industries, Inc., Barnhart, Mo.

[21] Appl. No.: 297,178

[22] Filed: Jan. 13, 1989

Related U.S. Application Data

[63] Continuation-in-part of Ser. No. 108,448, Oct. 15, 1987, abandoned.

[51] Int. Cl.[4] ..... G09F 3/14

[52] U.S. Cl. ..... 40/633; 40/304; 40/665

[58] Field of Search ..... 40/633, 665, 299, 304; 24/16 PB

[56] References Cited

U.S. PATENT DOCUMENTS 3,197, 899 8/1965 Twentier ..... 40/299

3,279,107 10/1966 Baumgartner ..... 40/633

4,078,324 3/1978 Wiebe ..... 40/633

*Primary Examiner*—James R. Brittain

*Assistant Examiner*—J. Hakomaki

*Attorney, Agent, or Firm*—Senniger, Powers, Leavitt and Roedel

[57] ABSTRACT

An identification band comprising a backing strip having pressure-sensitive adhesive thereon, two release strips on the adhesive, and an overlying transparent strip including a tongue extending at one end of the backing strip, the transparent strip being secured to the backing strip by the adhesive, one release strip being removable for application of a pre-printed insert to the backing strip, the insert then being covered by the transparent strip, the other release strip being removable for adhering the tongue to the backing strip at the other end thereof.

14 Claims, 2 Drawing Sheets

IDENTIFICATION BAND

CROSS-REFERENCE TO RELATED APPLICATION

This application is a continuation-in-part of my copending coassigned U.S. patent application Ser. No. 07/108,448 filed Oct. 15, 1987, entitled Identification Band, now abandoned.

BACKGROUND OF THE INVENTION

This invention relates to identification bands, and more particularly to such bands especially for hospital patients adapted to extend around a patient's wrist or ankle and to carry an insert, such as a paper label, having identification data pre-printed on one face thereof.

The invention is in the same general field as that of the bands disclosed in U.S. Pat. Nos. 2,561,894, 2,954,620, 3,027,665, 3,153,869, 3,197,899, 3,279,107, 4,078,324, 4,314,415 and 4,616,436.

SUMMARY OF THE INVENTION

Among the several objects of this invention may be noted the provision of an improved identification band particularly of the general type shown in U.S. Pat. Nos. 3,279,107, 4,314,415 and 4,616,436 which utilize an insert, such as a computer-generated paper label, preprinted with patient identification data, which band is of simplified, economical construction, which enables easy application of the insert, with the insert associated in waterproof manner with the band, and which, after application of the insert, may be readily applied to a patient's wrist or ankle and readily and effectively secured in place on the wrist or ankle by means of pressure-sensitive adhesive incorporated in the band.

In general, an identification band of this invention comprises a backing strip having pressure-sensitive adhesive on one face thereof, a first release strip overlying the adhesive on an insert-receiving portion of the backing strip, and a second release strip overlying the adhesive on a tab portion of the backing strip adjacent one end of the backing strip. The two release strips are spaced lengthwise of the backing strip with a gap between adjacent ends of the strips presenting an area of the adhesive between said adjacent ends of the strips. A transparent plastic strip is generally permanently adhered to the backing strip by the adhesive in said area between the adjacent ends of the release strips, having a window portion overlying the first release strip and a strap portion extending endwise from said window portion at the opposite end of the backing strip. The first release strip is removable by peeling it off the backing strip to expose the adhesive on said insert-receiving portion of the backing strip for application of the insert thereto with the printed face thereof facing out, the insert being smaller than said insert-receiving portion for securement of said window portion of the transparent strip by said adhesive to the backing strip around the insert. The band is adapted to encircle the wrist or ankle with the transparent strip on the outside for display of the printed face of the insert through said window portion. The second release strip is removable by peeling it off the backing strip to expose the adhesive on said tab portion of the backing strip for generally permanent securement of the strap to the tab by the adhesive on the tab.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figures 1, 2, 3, 4, 5, 6:
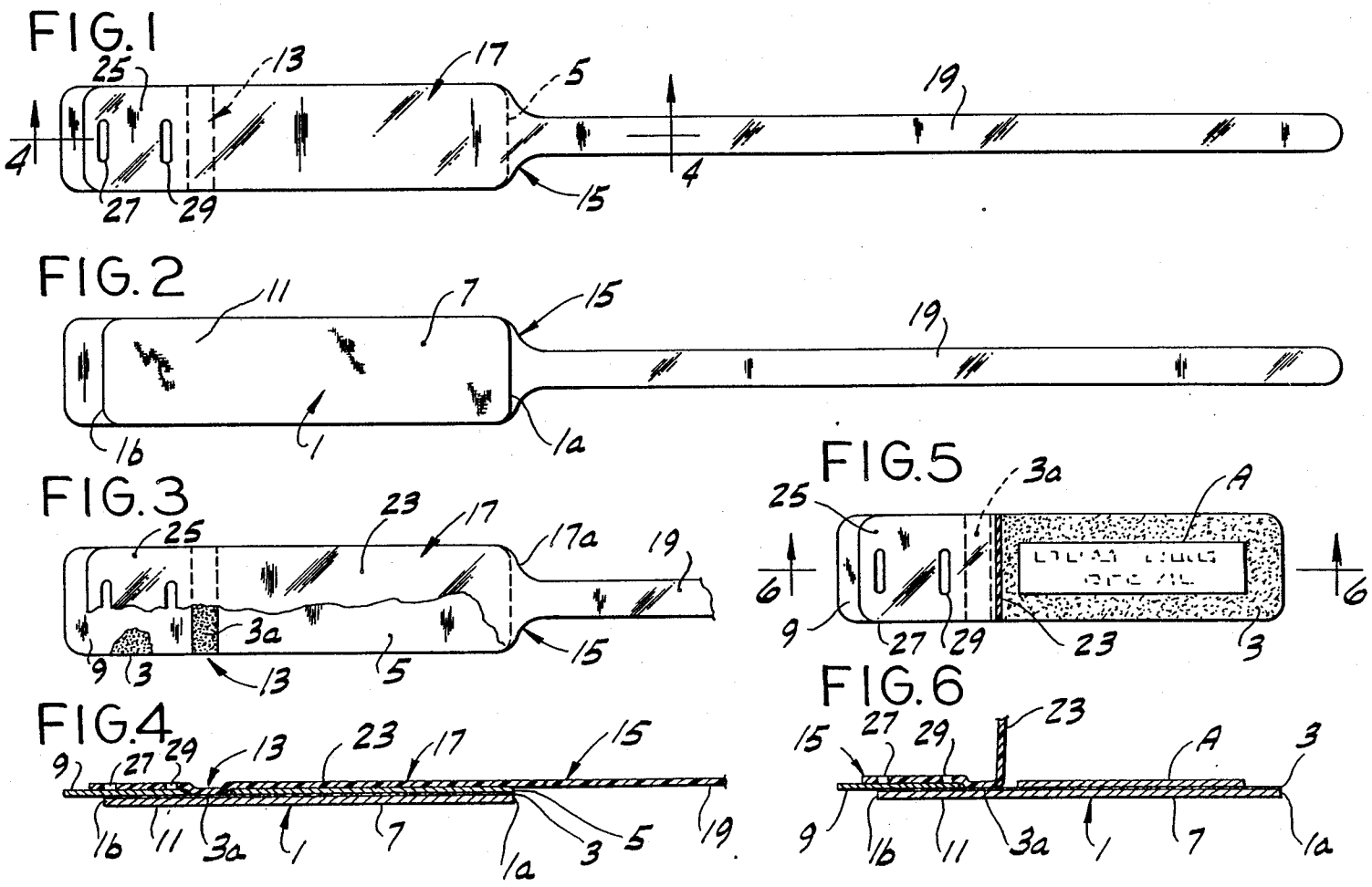
FIG. 1 is a plan of an identification band of this invention as supplied for application of an insert and as viewed from the side thereof which is on the outside as the band is applied to the wrist or ankle.
FIG. 2 is a view of the other side (the inside) of the band.
FIG. 3 is a fragment of FIG. 1 with layers broken away to show detail.
FIG. 4 is an enlarged longitudinal section of the band on line 4—4 of FIG. 1.
FIG. 5 is a view similar to FIG. 1 showing application of an insert to the band.
FIG. 6 is a longitudinal section on line 6—6 of FIG. 5.

Referring to the drawings, an identification band of this invention is shown to comprise a backing strip 1 having a pressure-sensitive adhesive 3 on one face thereof, this face constituting the face of the backing strip which is toward the outside as the band is applied to the wrist or ankle. The backing strip is preferably made of a relatively flexible nonstretchable waterproof material, e.g. 12–15 mil polyvinyl chloride film, which may be transparent or colored, colored film being used for code purposes. It is of generally long narrow rectangular shape, its length being greater than the width in general of a person's wrist and substantially greater than the length of the pre-printed insert A which is to be used with the band, and its width being greater than the width of the insert. The backing strip may be approximately 4 inches long and an inch wide, for example, the insert being approximately two inches long and $\frac{3}{8}$ inch wide, for example. The adhesive covers the backing strip from one end thereof to the other, the ends being designated 1*a* and 1*b*.

At 5 is indicated a first release strip, e.g. a strip of a suitable release paper, overlying the adhesive 3 on an insert-receiving portion 7 of the backing strip 1, and at 9 is indicated a second release strip, which may be of the same material as the first release strip 5, overlying the adhesive on what may be referred to as a tab portion 11 of the backing strip. The release strips 5 and 9 are spaced lengthwise of the backing strip with a gap at 13 between adjacent ends of the release strips, presenting an area 3*a* of the adhesive 3 between said adjacent ends of the release strips. Typically, with backing strip 1 four inches long and an inch wide the release strip 5 is approximately $2\frac{3}{4}$ inches long and an inch wide, and is applied to the adhesive-coated face of the backing strip extending inwardly $2\frac{3}{4}$ inches from the end 1*a* of the backing strip completely covering the adhesive 3 from end 1*a* to the inner end of the release strip 5 at the gap 13. Typically, the release strip 9 is approximately $1\frac{1}{8}$ inches long and one inch wide. As shown, it extends from about 5/16 inch outward of the end 1*b* of the backing strip over the adhesive 3 on the backing strip to the gap 13, although it may be made with a length corresponding to that of tab portion 11 of the backing strip without extending beyond end 1*b* of the backing strip. The gap at 13 may be about $\frac{1}{4}$-inch wide with the stated dimensions and arrangement of the strips.

At 15 is indicated a flexible transparent waterproof plastic strip having a main body portion 17 of a length corresponding generally to the length of the backing strip 1 and a width corresponding generally to the width of the backing strip, and an integral strap or tongue portion 19 narrower than the main body portion 17 and considerably longer than the latter extending generally centrally from one end, designated 17*a*, of the latter. The main body portion 17 of the transparent strip 15 overlies the release strips 5 and 9, bridging the gap at 13 between the adjacent ends of the release strips and being adhered to the backing strip 1 by the area 3*a* of adhesive 3 in this gap. That part of the main body portion 17 overlying the release strip 5 constitutes a window portion 23 of the transparent strip 15, the strap or tongue portion 19 of the transparent strip extending endwise from this said window portion at the end 1*a* of the backing strip 1.

The securement of the main body portion 17 of the transparent strip 15 to the backing strip 1 by the adhesive at 3*a* is generally a permanent securement, made so by utilizing a pressure-sensitive adhesive which effects a generally permanent bond between the backing strip 1 and the body portion 17 of the transparent strap 1 as a result of application of pressure. Thus, the transparent strap 15 may be made of 15–20 mil transparent polyvinyl chloride film, for example, and the pressure-sensitive adhesive 3 may be a synthetic rubber based adhesive such as styrene butadiene rubber (SBR) compounded with a suitable tackifying agent such as polyterpene resin or oil-soluble phenolic resin. Pressing the film against the adhesive provides a substantially permanent bond.

Portion 25 of the main body portion 17 of the transparent strip 15 overlying the release strip 9 and the tab portion 11 of the backing strip 1 has two openings 27 and 29 spaced lengthwise with respect to the band for passage of the strap or tongue 19 first through the first or outer opening 27 from the outside and then out through the second or inner opening 29 from the inside, as will appear. The openings 27 and 29 are preferably formed as slits in said tab-overlying portion 25 of the transparent strip extending transversely with respect to the band.

In the use of the identification band, the window portion 23 of the main body portion 17 of the transparent strip 15 is pulled back from the insert-receiving portion 7 of the backing strap 1 for access to the first release strip 5, and the latter is removed by peeling it off said insert receiving portion of the backing strip to expose the adhesive 3 on said portion 7 for application thereto of the insert A and the insert A is then applied to the adhesive 3 on portion of the backing strip, generally centered in respect to portion 7, as illustrated in FIGS. 5 and 6. The window portion 23 of the transparent strip is then brought back over portion 7 and the insert and pressed against the adhesive 3 on portion 7 all around the insert to effect a generally permanent securement of portion 23 to portion 7 all around the insert with the insert adhered to portion 7 and sealed in waterproof manner between portions 23 and 7, as appears in FIGS. 7 and 8.

Figure 7:
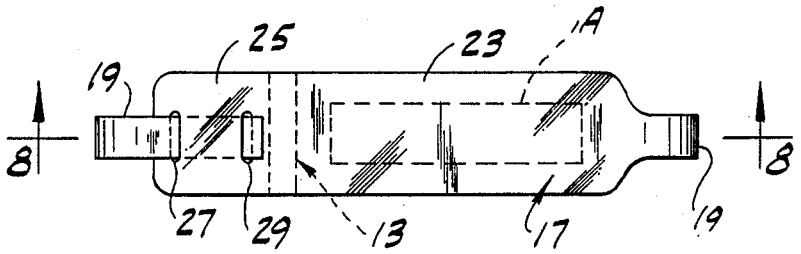
FIG. 7 is a plan of the band with the insert therein as the band is applied to the wrist or ankle.
Figure 8:
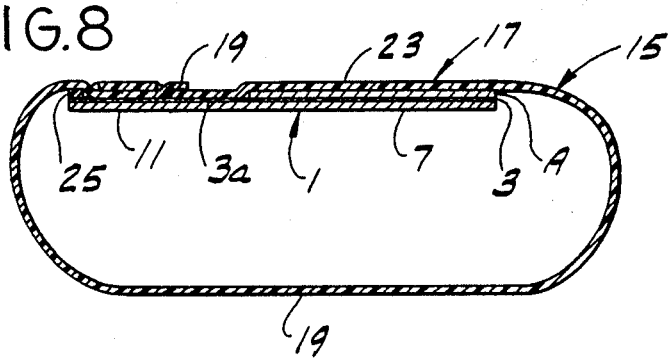
FIG. 8 is a section on line 8—8 of FIG. 7.

Following the application of the insert A, the band is placed around the wrist or ankle and the strap or tongue 19 is threaded first through the outer opening or slit 27 in the tab-overlying portion 25 from the outside, then up and out through the inner opening or slit 29 from the inside, as shown in FIGS. 7 and 8. The strap or tongue is pulled through the openings or slits to a point where the band fits well on the wrist or ankle but is still loose enough to permit removal of the release strip 9. The latter is then removed by peeling it off the tab portion 11 of the backing strip 1 and, subsequently, pressure engagement is effected of the portion of the strap or tongue 19 extending between the openings or slits 27 and 29 and the adhesive on the tab portion 11 of the backing strip thereby generally permanently to effect securement of the strap or tongue to said portion 11. The excess of the strap extending out of opening 29 may then be trimmed off.

Figure 9:
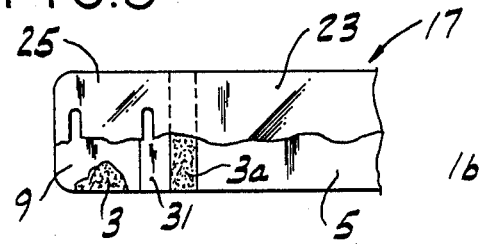
FIG. 9 is a view similar to FIG. 3 showing a modification.
Figure 10:
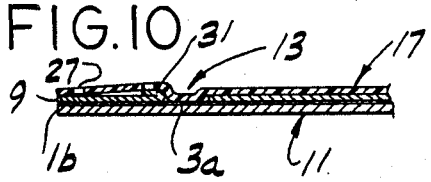
FIG. 10 is a longitudinal section of FIG. 9, similar to FIG. 4.

FIGS. 9 and 10 illustrate a modification in which the release strip 9 is provided at its inner end (at the gap 13) with a portion 31 folded back over itself adapted to be grasped by the fingers or by tweezers for facilitating peeling release strip 9 off tab portion 11. Also, as shown in FIGS. 9 and 10, the outer end of the release strip is coterminous with the end 1*b* of the backing strip 1.

Figure 11:
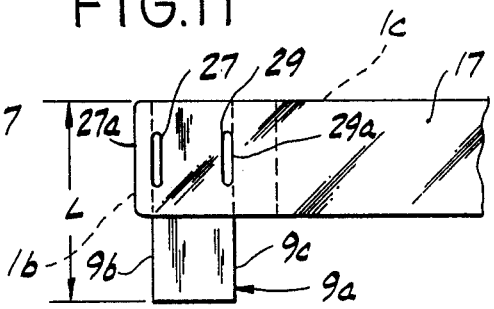
FIG. 11 is a view in plan of the left end portion of a band showing another modification.
Figure 12:
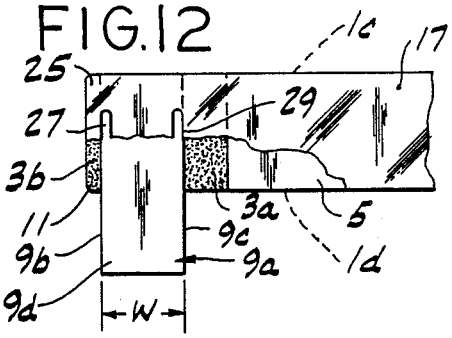
FIG. 12 is a view similar to FIG. 11 with a layer broken away to show detail.

FIGS. 11 and 12 illustrate a modification wherein the second release strip, here designated 9*a* to distinguish it from strip 9, is constituted by a strip of suitable release paper having a length L substantially greater than the width of the backing strip 1 (and the width of the main body portion 17 of the transparent strip 15) and a width W such as to cover the adhesive 3 on the tab portion 11 of the backing strip 1 between the openings or slits 27*a* and 29 in the portion 25 of the transparent strip 15. Preferably, the width W corresponds generally to the spacing of the outer edge portion 27*a* of the outer slit 27 and the outer edge portion 29*a* of the inner slit 29. The release strip 9*a* is positioned to underlie both slits with the side edge 9*b* of the strip toward the end 1*b* of the backing strip generally at the outer edge portion 27*a* of the outer slit 27 and the other side edge 9*c* of the strip generally at the outer edge portion 29*a* of the inner slit 29, and with the strip 9*a* extending transversely across the backing strip 1 from adjacent one side edge 1*e* thereof over the area of the adhesive 3 thereon between the slits and projecting beyond the other side edge 1*d* of the backing strip, thereby having a portion 9*d* readily available for grasping to remove the strip 9*a* from the backing strip 1.

The transparent strip 15 is secured to the backing strip by adhesive at 3*a* in the gap between the inner end of the release strip 5 and the side edge 9*c* of the release strip 9, and by adhesive at 3*b* between the end 1*b* of the backing strip 1 and the side edge 9*b* of the release strip 9*a*. Between the slits 27 and 29, the adhesive on the backing strip 1 is covered by the strip 9*a* permitting the insertion of the strap or tongue 19 through the first slit 27 from the outside and then out through the second slit 29 from the inside. Insertion of the strap or tongue 19 is facilitated by reason of the fact that with a rounded end as shown in FIGS. 1 and 2, or a tapered end, the strap or tongue is effectively guided into and through the slit 29 (after insertion through the slit 27).

In view of the above, it will be seen that the several objects of the invention are achieved and other advantageous results attained.

As various changes could be made in the above constructions without departing from the scope of the invention, it is intended that all matter contained in the above description or shown in the accompanying drawing shall be interpreted as illustrative and not in a limiting sense.

What is claimed is:

1. An identification band, as for hospital patients, adapted to extend around a person's wrist or ankle and to carry an insert, such as a paper label, having identification data pre-printed on one face thereof, said band comprising:

a backing strip having pressure-sensitive adhesive on one face thereof covering the strip from one end thereof to the other, a first release strip overlying the adhesive on an insert-receiving portion of the backing strip, a second release strip overlying the adhesive on a tab portion of the backing strip adjacent one end of the backing strip, said strips being spaced lengthwise of the backing strip with a gap therebetween presenting an area of the adhesive between said strips, said backing strip being of elongate rectangular shape, the adhesive thereon covering it from one side edge thereof to the other as well as from said one end thereof to the other, said first release strip having a width corresponding to the width of the backing strip, said first release strip and said insert-receiving portion of the backing strip extending from the other end of the backing strip toward but terminating at said gap short of the said one end of the backing strip, said tab portion of the backing strip extending from one end of the backing strip to the gap, a transparent plastic strip having a generally elongate rectangular portion having a width corresponding to the width of the backing strip and a length corresponding generally to the length of the backing strip overlying the first and second release strips, extending from adjacent the said one end of the backing strip to said other end of the backing strip, and generally permanently adhered to the backing strip by the adhesive in said area between the release strips, said generally elongate rectangular portion of said transparent plastic strip comprising a window portion overlying the first release strip and an integral end portion overlying the second release strip on said tab portion of the backing strip, said transparent plastic strip further having an elongate strap portion narrower than said generally elongate rectangular portion extending endwise from said window portion at said other end of the backing strip, said integral end portion of said generally elongate rectangular portion of the transparent plastic strip having at least one opening for passage therethrough of said strap portion, the first release strip being removable by peeling it off said insert-receiving portion of the backing strip to expose the adhesive on said insert-receiving portion of the backing strip for application of the insert thereto with the printed face thereof facing out, the insert being smaller than said insert-receiving portion for securement of said window portion of the transparent strip by said adhesive to the backing strip around the insert, the band being adapted to encircle the wrist or ankle with the transparent strip on the outside for display of the printed face of the insert through said window portion, and the second release strip being removable by peeling it off the backing strip to expose the adhesive on said tab portion of the backing strip for generally permanent securement of the strap portion to the tab portion by the adhesive on the tab portion after passage of the strap portion through said opening.

2. An identification band as set forth in claim 1 wherein the backing strip comprises a generally long, narrow rectangular piece of non-stretchable waterproof material.

3. An identification band as set forth in claim 2 wherein the backing strip is a strip of colored plastic material.

4. An identification band as set forth in claim 1 wherein the second release strip extends out from between tab portion of the backing strip and the tab-overlying portion of the transparent strip.

5. An identification band as set forth in claim 1 wherein the second release strip has a portion folded back over itself at its inner end.

6. An identification band as set forth in claim 1 wherein said tab-overlying integral end portion of the transparent strip has two openings spaced lengthwise with respect to the band for passage of the strap portion first through the outer of the two openings from the outside and then out through the inner of the two openings from the inside.

7. An identification band as set forth in claim 6 wherein the openings are slits in said tab-overlying portion of the transparent strip extending transversely with respect to the band.

8. An identification band as set forth in claim 7 wherein the second release strip extends out from between the tab portion of the backing strip and the tab-overlying portion of the transparent strip.

9. An identification band as set forth in claim 7 wherein the second release strip has a portion folded back over itself at its inner end.

10. An identification band as set forth in claim 1 wherein the second release strip extends laterally outward from between the tab portion of the backing strip and the tab-overlying portion of the transparent strip.

11. An identification band as set forth in claim 6 wherein said second release strip has a length substantially greater than the width of the backing strip and a width such as to cover the adhesive on the tab portion of the backing strip between said openings and wherein said second release strip is positioned between the tab portion of the backing strip and the tab-overlying portion of the transparent strip covering the adhesive on the tab portion of the backing strip between said openings and extending transversely across the backing strip from adjacent one side edge thereof over the area of the adhesive thereon between said openings and projecting outwardly beyond the other side edge of the backing strip.

12. An identification band as set forth in claim 11 wherein the second release strip is of such width and is so positioned as to underlie both openings with the side edge of the second release strip away from said one end of the backing strip generally at the outer edge portion of the inner opening.

13. An identification band as set forth in claim 7 wherein the second release strip has a length substantially greater than the width of the backing strip and a width such as to cover the adhesive on the tab portion of the backing strip between said slits and wherein said second release strip is positioned between the tab portion of the backing strip and the tab-overlying portion of the transparent strip covering the adhesive on the tab portion of the backing strip between said slits and extending transversely across the backing strip from adjacent one side edge thereof over the area of the adhesive thereon between said slits and projecting outwardly beyond the other side edge of the backing strip.

14. An identification band as set forth in claim 13 wherein the second release strip is of such width and is so positioned as to underlie both slits with the side edges of the second release strip generally at the outer edge portions of the inner slits.

* * * * *